US006632082B1

(12) United States Patent
Smith

(10) Patent No.: US 6,632,082 B1
(45) Date of Patent: Oct. 14, 2003

(54) LIGHTER AND METHOD OF USE

(75) Inventor: Andrew D. Smith, Pascoag, RI (US)

(73) Assignee: Colibri Corporation, Providence, RI (US)

( * ) Notice: Subject to any disclaimer, the term of this patent is extended or adjusted under 35 U.S.C. 154(b) by 0 days.

(21) Appl. No.: 10/136,199

(22) Filed: May 1, 2002

(51) Int. Cl.[7] ..... F23Q 25/00; F23D 14/28

(52) U.S. Cl. ..... 431/152; 431/255; 431/344; 431/175

(58) Field of Search ..... 431/152, 153, 431/277, 344, 345, 278, 350, 354, 175, 176, 255; 239/418, 433, 579

(56) References Cited

U.S. PATENT DOCUMENTS

| | | | |
|---|---|---|---|
| 1,359,128 | A | 11/1920 | Trost |
| 1,928,428 | A | 9/1933 | Irwin |
| 2,697,485 | A | 12/1954 | McNally |
| 3,190,087 | A | 6/1965 | Kitabayashi |
| 3,807,941 | A | 4/1974 | Malamoud |
| 4,179,260 | A | 12/1979 | Lowenthal |
| 4,487,570 | A | 12/1984 | Lowenthal |
| 4,505,666 | A | 3/1985 | Martin et al. |
| 5,308,240 | A | 5/1994 | Lowenthal |
| 5,423,483 | A | 6/1995 | Schwade |
| 5,669,426 | A | 9/1997 | Fontaine, Jr. |
| 5,688,115 | A | 11/1997 | Johnson |
| 5,711,662 | A | 1/1998 | Ishiguro |
| 5,738,117 | A | 4/1998 | Fontaine, Jr. |
| 5,755,568 | A | 5/1998 | Buhler |
| 5,888,061 | A | 3/1999 | Reynolds |
| 6,152,725 | A | 11/2000 | Lee |

FOREIGN PATENT DOCUMENTS

| | | | |
|---|---|---|---|
| FR | 2 615 597 | 11/1988 | |
| JP | 11-6620 | 5/1999 | |
| RU | 787795 | * 12/1980 | ..... 431/175 |
| WO | WO81/00751 | 3/1981 | |

* cited by examiner

*Primary Examiner*—James C. Yeung
(74) *Attorney, Agent, or Firm*—Salter & Michaelson

(57) ABSTRACT

A lighter is provided. The lighter includes two spaced apart nozzles. Upon manual actuation of the lighter, each nozzle produces a separate flame, and the flames intersect to produce a single flame in region spaced apart from the body of the lighter.

20 Claims, 6 Drawing Sheets

LIGHTER AND METHOD OF USE

RELATED CASES

Priority for this application is hereby claimed under 35 U.S.C. §120 to commonly owned and co-pending U.S. Des. patent application Ser. No. 29/156,980 which was filed on Mar. 11, 2002 and which is incorporated herein by reference in its entirety.

BACKGROUND

1. Technical Field

The present disclosure is related to a lighter and, in particular, to a lighter that produces intersecting flames.

2. Related Art

Many types of lighters have been manufactured to include features that make them more useful and/or attractive to consumers. The patent literature includes examples of some lighters have been manufactured to include more than one gas nozzle in attempts to improve the characteristics of lighters.

One example is U.S. Pat. No. 6,152,725 which discloses a turbo-jet lighter with three nozzles.

Another example is U.S. Pat. No. 5,711,662 to Ishiguro which discloses a gas lighter in which two gas nozzles are angularly disposed outwardly with respect to the axis of the burner head in order to produce a large flat flame.

SUMMARY

The present disclosure is directed to an improved lighter that includes at least two nozzles which, when lit, provide two separate flames that intersect in a region spaced apart from the body of the lighter.

In one embodiment, the lighter has a body and includes a fuel reservoir and an ignition mechanism, each contained within the body. The lighter also includes a first nozzle and a second nozzle, each nozzle having an upper end, and each nozzle being fluidly connected to the reservoir and at least partially contained within the body. A switch is operatively connected to both the fuel reservoir and the ignition mechanism. Upon manual actuation of the switch, the first nozzle generates a first flame and the second nozzle generates a second flame intersecting the first flame in a region spaced from the upper end of the first and second nozzles.

In another embodiment, the lighter includes a first nozzle and a second nozzle positioned at an angle of about 5 to about 45 degrees to the first nozzle. Each nozzle is fluidly connected to the reservoir. A switch is operatively connected to both the fuel reservoir and to the ignition mechanism. Upon manual actuation of the switch, a first flame is generated from the first nozzle and a second flame is generated from the second nozzle, each of the flames intersecting in a region spaced from an upper end of the first and second nozzles.

In yet another embodiment, upon manual actuation of the switch, a first flame is generated from the first nozzle and a second flame is generated from the second nozzle, each of the flames intersecting in a region spaced apart from an upper end of the body by at least about ½ centimeter.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

The present invention is directed to a lighter that provides intersecting flames, resulting in improved lighting and an interesting and unique appearance.

Figure 1:
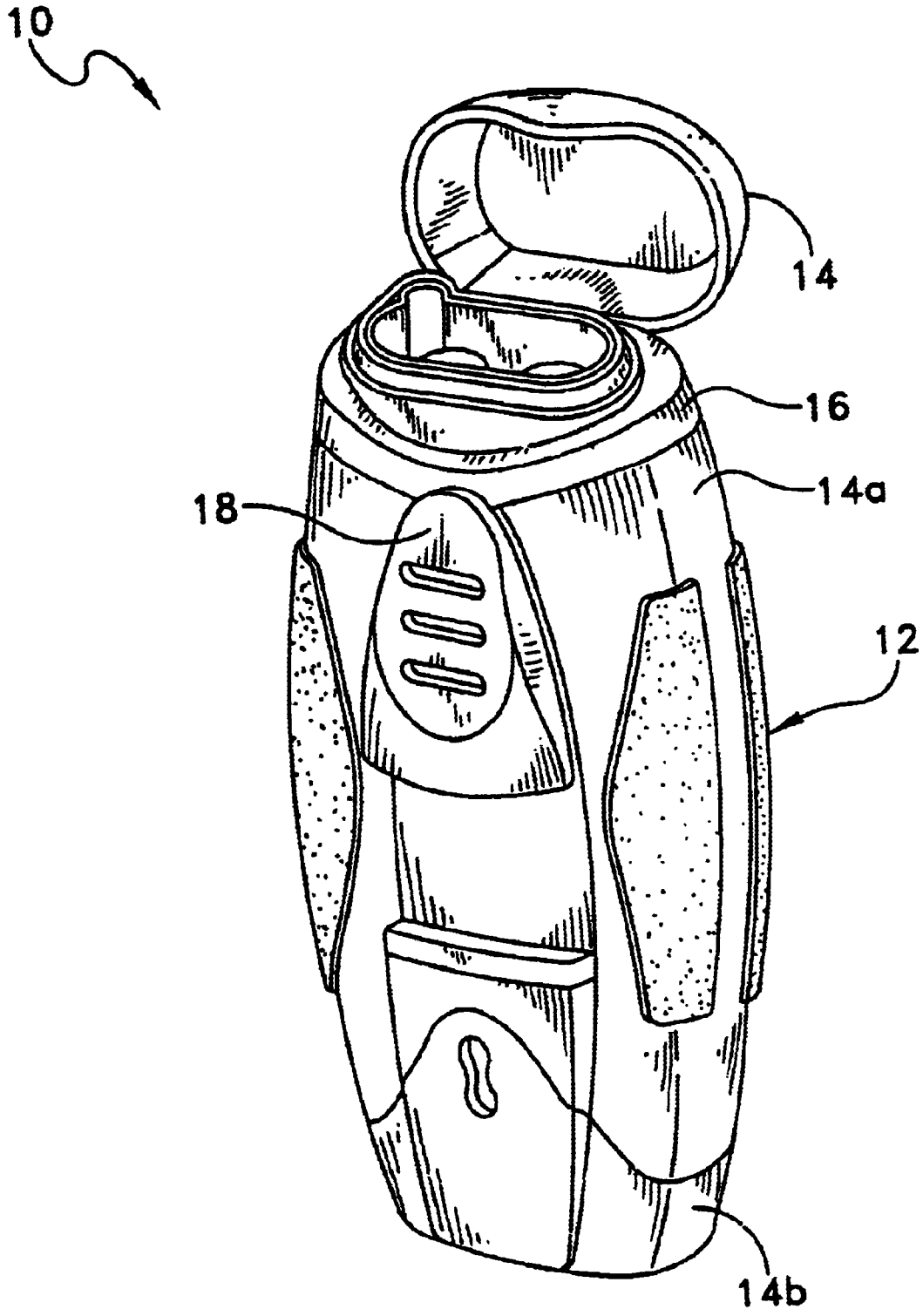
FIG. 1 is a perspective view of a lighter according to one embodiment of the invention.
Figure 2:
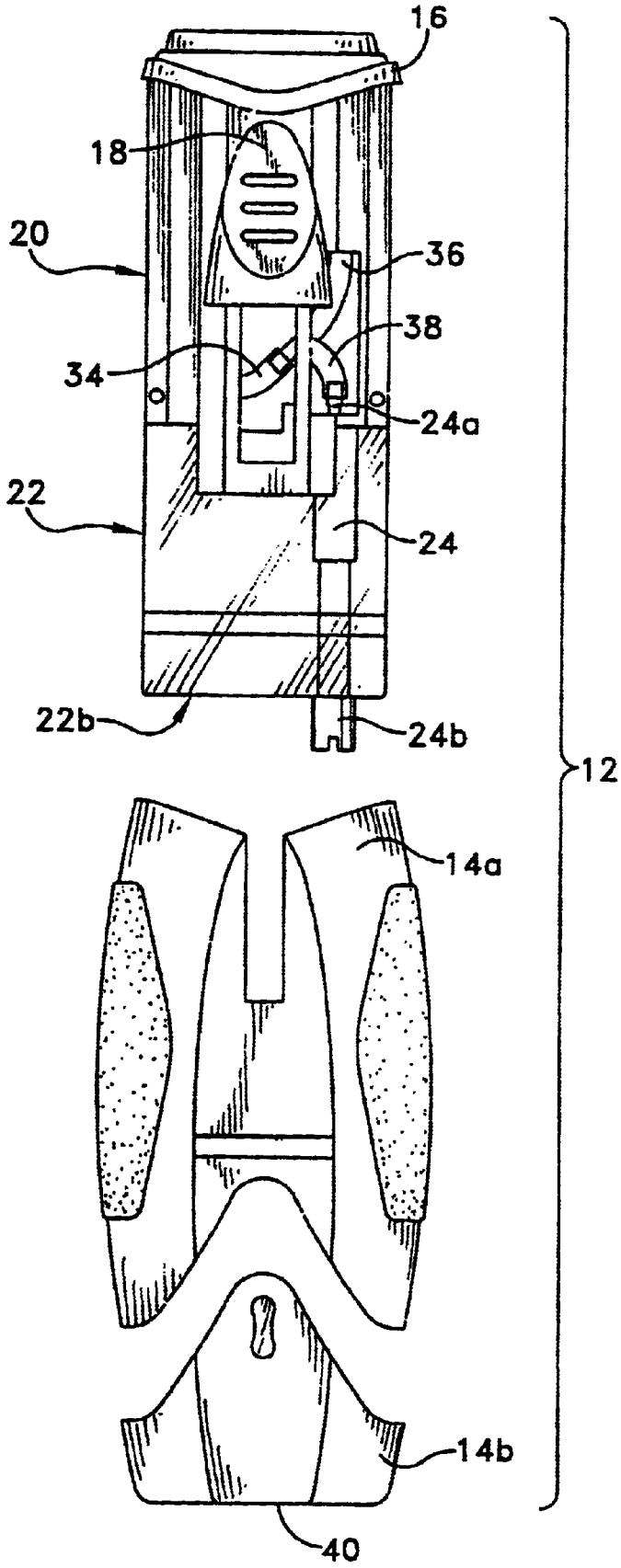
FIG. 2 shows an exploded view of portions of the lighter shown in FIG. 1.

Referring initially to FIGS. 1 and 2 when taken together, lighter 10 according to the present disclosure includes a body 12 and a cap 14. Cap 14 may be attached to body 12 by any means including, as in the present embodiment, by a fastener such as a hinge (not illustrated). Body 12 includes an upper housing 14*a* and a lower housing 14*b* having a base 40. When assembled, body 12 houses other components of lighter 10 including a body insert 16. Body insert 16 is adapted to be slidably received into upper and lower housing 14*a,b* when they are assembled.

Figure 7:
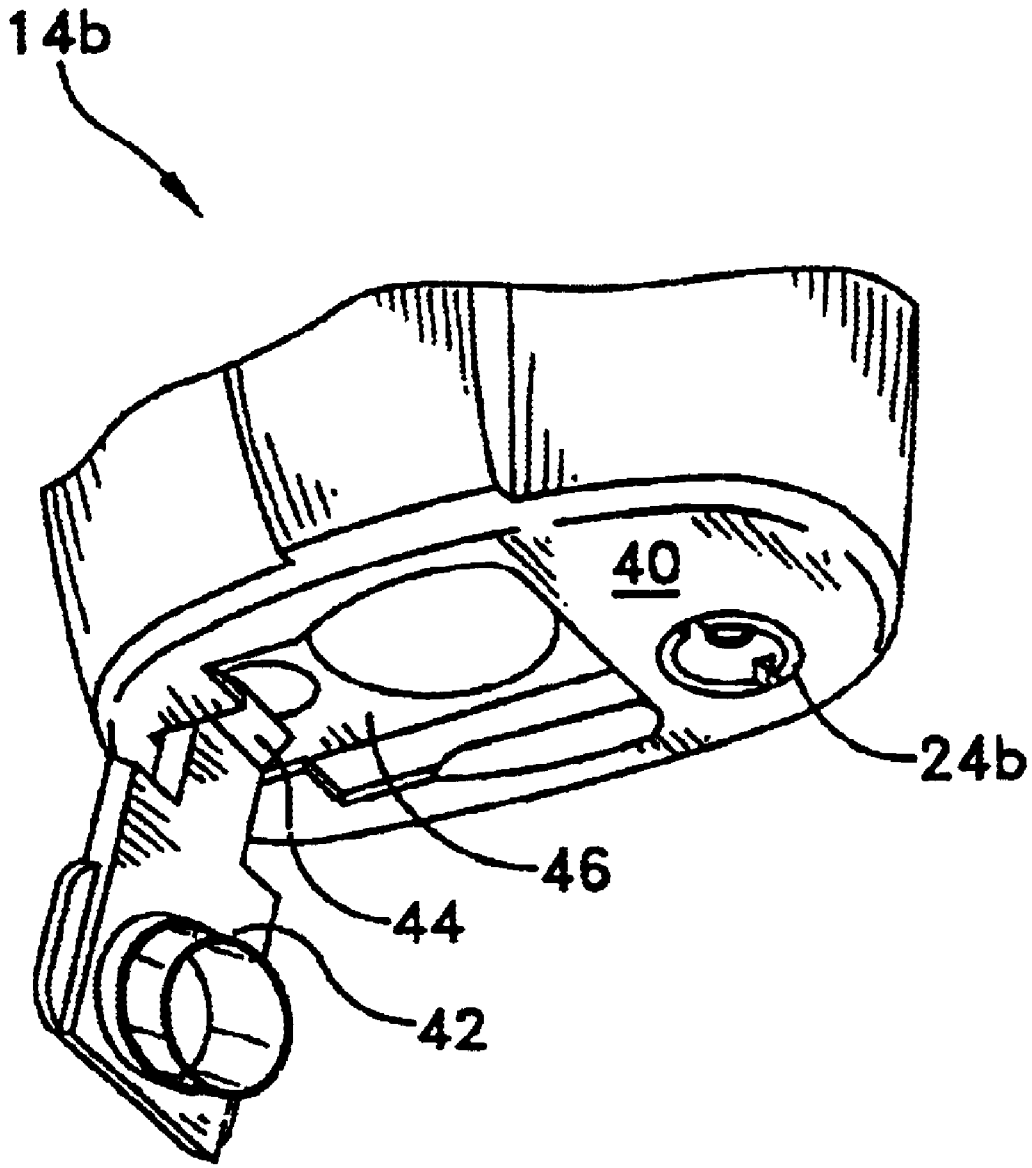
FIG. 7 shows a bottom view of the lighter of FIG. 1, including a cigar cutter.

As shown in FIG. 2, body insert 16 includes a nozzle assembly housing 20 supported on a reservoir tank 22, having upper and lower ends 22*a,b*. Reservoir tank 22 may be used to contain, for example, lighter fluid. If desired, nozzle assembly housing 20 may be connected to reservoir tank 22 in any way, for example, with screws, by friction fitting, gluing, and the like. An injection nozzle 24 having an upper end 24*a* and a lower end 24*b* extends through upper and lower ends 22*a,b* of reservoir tank 22, respectively. When assembled, lower end 24*b* of injection nozzle 24 extends through an aperture (not illustrated) in base 40 of lower housing 14*b*, as best shown in FIG. 7 A switch 18 that may be operatively connected to both an ignition mechanism (not illustrated) and to injection nozzle 24, extends through upper housing 14*a* when body insert 16 is inserted into upper and lower housing 14*a,b*.

Figure 3:
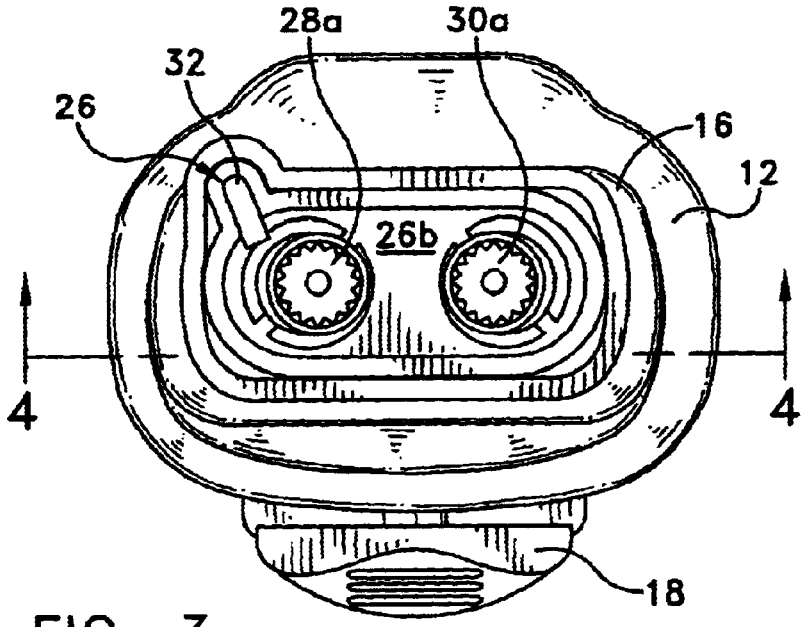
FIG. 3 shows a top view of the housing of the lighter shown in FIG. 1, without the cover.
Figure 4:
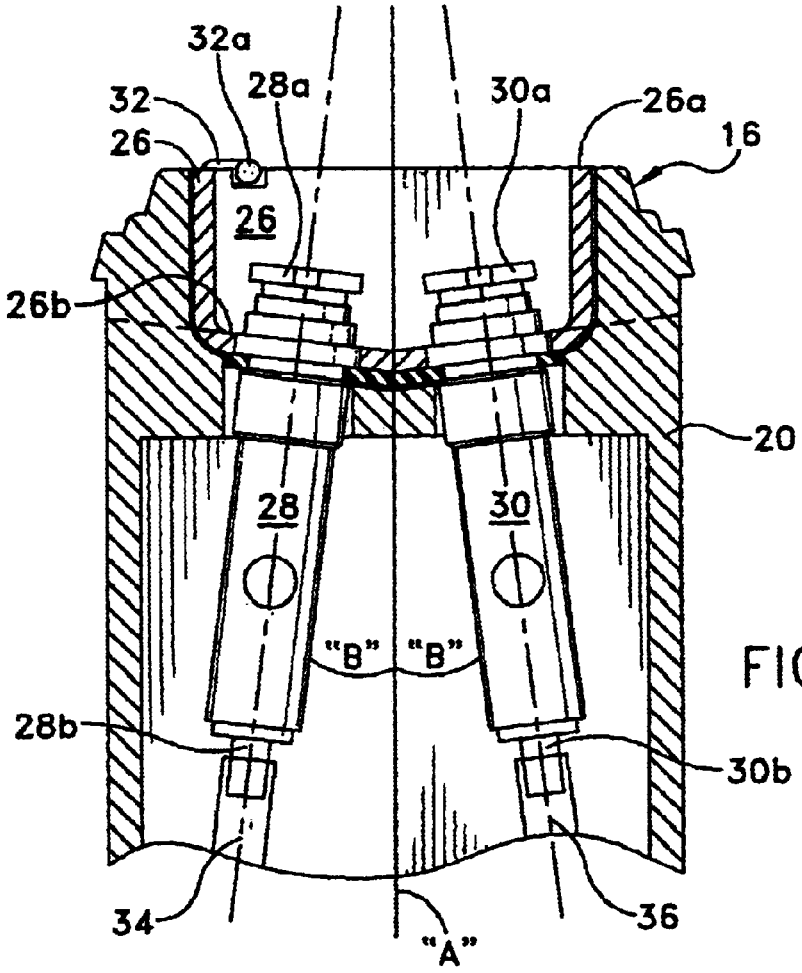
FIG. 4 shows a partial schematic view of the housing through lines "4—4" of FIG. 3.

Referring to FIGS. 3 and 4, lighter 10 also includes two nozzles 28, 30, each of which is disposed at an angle "B" with respect to axis "A." Angle "B" may be varied according to the design of the lighter, but it is desirable to maintain the angle of nozzles 28,30 within a few degrees of one another in order to be able to produce the intersecting flames according to the present disclosure. Preferably, the angular disposition of nozzles 28,30 may range from about 5 degrees to about 45 degrees. In preferred embodiments, angle "B" may be about 20 degrees. Of course, the dimensions of the body may be varied to accommodate the angular disposition of the nozzles.

If desired, and as shown in the present embodiment, lighter 10 also may include a ceramic insert 26 having an upper edge 26*c*, sidewalls 26*a*, and a base 26*b* that slopes downwardly toward axis "A." When ceramic insert 26 is included, two spaced apart apertures (not illustrated) are formed in base 26*b* of ceramic insert 26, each of which is adapted to receive one of nozzles 28,30 therethrough. When ceramic insert 26 is included, the angular disposition of base 26*b* defines the angular disposition of each nozzle 28,30 with respect to axis "A." The angular disposition of base 26*b* may be any angle that provides the desired intersection of flames, as described below.

Although not illustrated herein, a spark ignition mechanism also is housed in body 12 for generating a spark in close proximity to nozzle heads 28*a*,30*a* upon actuation of switch 18, as will be described in greater detail below. Also as shown in FIGS. 3 and 4, an ignition wire 32 extends from the ignition mechanism (not illustrated) to an ignition wire tip 32*a*, which is positioned in ceramic insert 26. Many types of spark ignition mechanisms are known in the art. Examples of suitable ignition mechanisms include, but are not limited to, piezo electric devices, which is preferred in the present embodiment. As shown in FIG. 4, base 28*b*,30*b* of each nozzle 28,30 is separately attached to separate lengths of tubing 34,36, each of which is fluidly connected to a T-junction 38 (FIG. 2), which is in turn fluidly connected to reservoir tank 22 via upper end 24*a* of injection valve 24. Alternatively, a second injection valve may be provided for separate fluid connection of each tubing 34,36 to reservoir tank 22.

In operation, manual actuation of switch 18 causes injection valve 24 to deliver lighter fluid through T-junction 38, into tubing 34,36, through both nozzles 28,30 and out of nozzle ends 28*a*,30*a*. At substantially the same time, the ignition mechanism delivers a spark to ignition wire tip 32*a* and into the ceramic insert 26 in proximity to nozzle ends 28*a*,30*a*, resulting in ignition of the lighter fluid expelled from nozzle ends 28*a*,30*a*.

Figure 5:
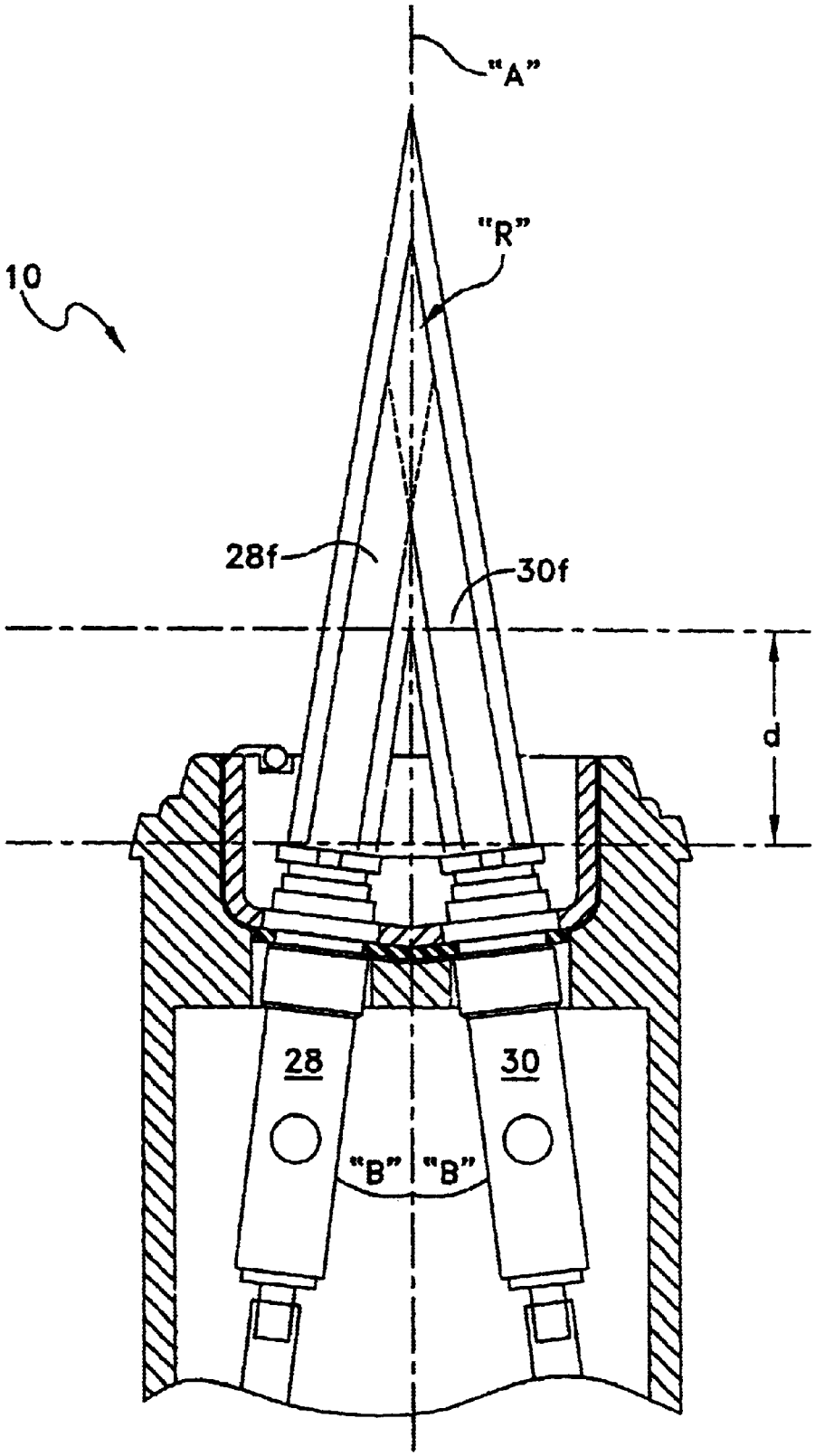
FIG. 5 shows a partial schematic view of the intersecting flames produced by the present lighter.
Figure 6:
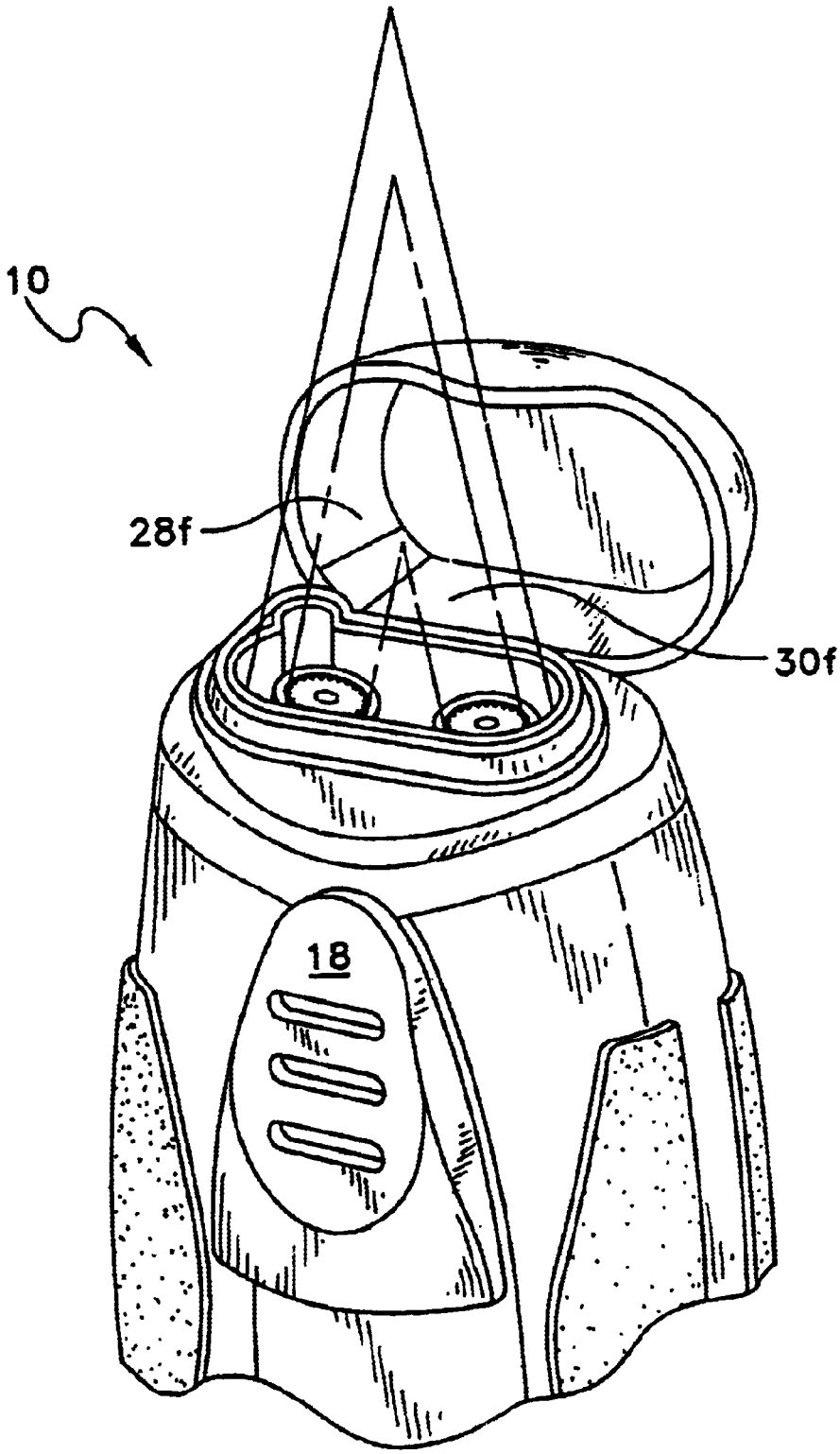
FIG. 6 shows a partial perspective view of the lighter showing the flames produced by the present lighter.

FIGS. 5 and 6, when taken together, illustrate the resulting flame produced from the present lighter after actuation of switch 18. As shown, the angular disposition of nozzles 28,30 produces two intersecting flames 28*f*,30*f*. The resulting combined flame has a generally inverted Vee shape, as shown in the figures Flames 28*f*,30*f* intersect at a distance "d" from an upper end of body 12 to produces a region "R." Typically, distance "d" may range from about ½ centimeter to about 5centimeters, depending on the angular disposition of nozzles 28,30.

Region "R" represents the area defined by the intersection of the "blue" regions of flames 28*f*,30*f*, which has a generally higher temperature than that produced by a single flame from a single injection nozzle having a size comparable to those used herein. As a result, region "R" provides improved ease of lighting of objects such as cigars and cigarettes, and has a pleasing and interesting appearance.

If desired, lighter 10 also may include other features. For example, as shown in FIG. 7, base 40 of lower housing 14*b* may include a recess 46 into which a cigar cutter 42 may be positioned, and which may be retracted from recess 46 by a hinge 44. Such cigar cutters are well known in the art.

Although particular embodiments of the invention have been described in detail for purposes of illustration, various changes and modifications may be made without departing from the scope and spirit of the invention. For example, additional nozzles may be provided to produce additional intersecting flames and consequently higher heat. This may be accomplished by changing the dimensions of the lighter and ceramic insert to accommodate the additions, as would be understood by those of ordinary skill in the art.

What is claimed is:

1. A lighter having a body, comprising:

a fuel reservoir and an ignition mechanism, each contained within the body;

first nozzle and a second nozzle, each nozzle having an upper end, each nozzle being fluidly connected to the reservoir and at least partially contained within the body; and a switch operatively connected to both the fuel reservoir and the ignition mechanism;

wherein, upon manual actuation of the switch, the first nozzle generates a first flame and the second nozzle generates a second flame intersecting the first flame in a region spaced from the upper end of the first and second nozzles.

2. The lighter of claim 1, wherein each nozzle is disposed at an angle with respect to an axis bisecting the body.

3. The lighter of claim 2, wherein the angle is about 5 to about 45 degrees.

4. The lighter of claim 2, wherein the angle is about 20 degrees.

5. The lighter of claim 2, wherein the angle of the first nozzle is substantially the same as the angle of the second nozzle.

6. The lighter of claim 1, further comprising a ceramic insert positioned in the body.

7. The lighter of claim 1, wherein the ceramic insert includes a base and a sidewalls extending upwardly from the base, and two spaced apart apertures positioned in the base, and wherein the base slopes downwardly from the sidewalls toward the axis.

8. The lighter of claim 7, wherein the first and second nozzles are each positioned in one of the apertures.

9. The lighter of claim 7, wherein the base of the ceramic insert slopes downwardly from the sidewalls at an angle ranging from about 5 degrees to about 45 degrees.

10. The lighter of claim 1, wherein the first flame and the second flame intersect at an angle ranging from about 5 degrees to about 45 degrees.

11. The lighter of claim 1, wherein the first flame and the second flame intersect at an angle of about 20 degrees.

12. The lighter of claim 1, further comprising a cover connected to the body.

13. The lighter of claim 1, further comprising a cigar cutter.

14. The lighter of claim 13, wherein the body includes an upper housing and a lower housing, and the retractable cigar cutter is positioned in the lower housing.

15. The lighter of claim 1, wherein the first and second flames intersect at a distance of about ½ to about 5 centimeters from the upper end of the body.

16. The lighter of claim 1, wherein the first and second flames intersect at a distance of about 2 centimeters from the upper end of the body.

17. A lighter having a body, comprising:

a fuel reservoir an ignition mechanism each contained within the body;

a first nozzle positioned at an angle of about 5 to about 45 degrees to a second nozzle, each nozzle being fluidly connected to the reservoir; and a switch operatively connected to both the fuel reservoir and to the ignition mechanism;

wherein, upon manual actuation of the switch, a first flame is generated from the first nozzle and a second flame is generated from the second nozzle, each of the flames intersecting in a region spaced from an upper end of the first and second nozzles.

18. A lighter having a body, comprising:

a fuel reservoir and an ignition mechanism, each contained within the body;

a first nozzle and a second nozzle, each being fluidly connected to the reservoir; and a switch operably connected to both the fuel reservoir and to the ignition mechanism;

wherein, upon manual actuation of the switch, a first flame is generated from the first nozzle and a second flame is generated from the second nozzle, each of the flames intersecting in a region spaced apart from an upper end of the body by at least about ½ centimeter.

19. The lighter of claim 18, wherein the flames intersect at a region spaced apart from an upper end of the body by less than about 5 centimeters.

20. The lighter of claim 19, wherein the flames intersect at an angle of about 5 degrees to about 45 degrees in the region.

* * * * *